United States Patent [19]

Muller

[11] 4,261,495

[45] Apr. 14, 1981

[54] BAG CONSTRUCTION

[76] Inventor: Christoph Muller, Kleiner Muristalden 26, CH-3006 Bern, Switzerland

[21] Appl. No.: 68,992

[22] Filed: Aug. 23, 1979

[30] Foreign Application Priority Data

Sep. 1, 1978 [DE] Fed. Rep. of Germany ..... 2838289

[51] Int. Cl.[3] ..... A45F 5/00

[52] U.S. Cl. ..... 224/208; 224/164

[58] Field of Search ..... 224/208, 215, 164, 49, 224/55, 58, 150

[56] References Cited

U.S. PATENT DOCUMENTS

| | | | |
|---|---|---|---|
| 2,383,628 | 8/1945 | Traum | 224/164 X |
| 3,541,976 | 11/1970 | Rozas | 224/208 X |
| 3,910,470 | 10/1975 | Swenson et al. | 224/208 |
| 3,997,092 | 12/1976 | Pogwizd | 224/208 |

*Primary Examiner*—Steven M. Pollard

*Attorney, Agent, or Firm*—Neuman, Williams, Anderson & Olson

[57] ABSTRACT

A shoulder bag such as a photography case adapted to be suspended from a shoulder of a bearer of the same is suspended by means of a strap engaging opposed pivot pins projecting outwardly from opposed side walls of such bag. An upper rear edge portion of the bag is inwardly arched or concave so as to generally fit over the hip of the bag bearer, and a waist-encircling band passes through recessed portions of such upper edge. As a result, the bag is suspended from the shoulder by means of the suspension strap engaging the opposed projecting ends as well as secured to the body of the wearer by means of the waist-encircling band. As points of suspension of the bag are in vertical alignment with the center of gravity of the bag, the bag will obliquely pivot outwardly from the body of the bearer and contact the body of the bearer solely where engaging the hip portion by means of the waist encircling band and upper rib.

6 Claims, 4 Drawing Figures

BAG CONSTRUCTION

This invention pertains to a bag or case adapted to be suspended from a shoulder, and more particularly pertains to a bag possessing a novel suspension arrangement enabling the bag to extend obliquely from the hip of the bearer and not impede normal walking motion of such bag bearer.

Bags or cases such as photography cases for carrying camera lenses, filters and other accessories are, of course, well known in the art. Normally such cases or bags are suspended from the shoulder by a strap and the bag loosely dangles downwardly and swings to and fro in the course of walking movement of the bearer.

In accordance with the case of this invention, a construction is provided which eliminates the awkward swinging action of the bags of the prior art by providing a construction in which the bag is desirably located against the body of the person carrying the same whereby the bag does not move relative to the individual carrier or bearer during normal walking.

Thus, whereas the normal bags of the prior art have a wall portion engaging the person of the carrier in the thigh or hip region whereby the bag rubs against the body in such regions and impedes free walking, it is an object of this invention to eliminate such previous loose swinging action of the prior art bags.

It is a further object of this invention to provide a bag structure which desirably positions a suspended bag relative to the body of the bearer whereby the bag suspension points enable such bag to contact the bearer along an upper edge at the waist only while the remaining bag portion obliquely extends from the body of the bearer.

The above and other objects of this invention will become more apparent from the following detailed disclosure when read in the light of the accompanying drawing and appended claims.

In one embodiment of the provided bag or case construction such as a photography case adapted to contain various photographical accessories possesses a rear wall normally engaged by the body of the bearer. The wall has an upper edge defining a concave rib curved to generally conform with the body of the bearer. The bag is suspended by means of a strap engaging the shoulder of the bag bearer. The distal ends of the strap engage anchors pivotally engaging projecting pins projecting from and secured to opposed sides of the suspended bag. Thus, the bag may freely pivot relative to the supporting strap. In addition, a waist encircling band which engages the waist of the bearer similarly to a belt, engages pins disposed in spaced recess portions of the curved rib. The controlled suspension of the bag thus enables the same to be displaced laterally outwardly relative to the point of engagement of the bag rib with the body of the bearer. Such oblique downwardly extending disposition of the bag relative to the body of the bearer thereby prevents the rubbing of the bag against the body of the bearer in the course of bearer movement.

For a more complete understanding of this invention reference will now be made to the drawing wherein.

Figure 3:
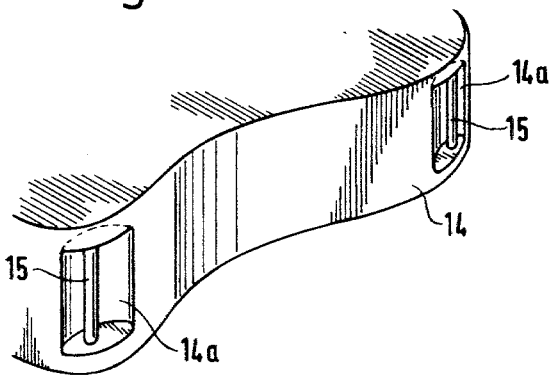
Figure 4:
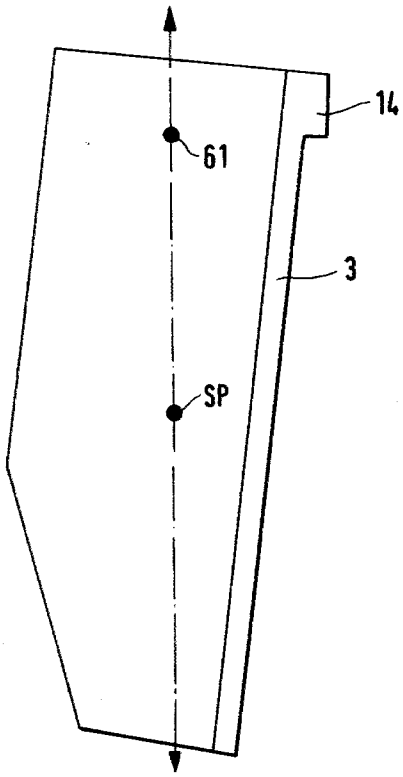

FIG. 3 comprises a fragmentary perspective view illustrating a case upper edge rib-like portion and the recessed guide pins for a waist encircling band of the bearer; and FIG. 4 is a schematic view illustrating the normal suspension of a case made in accordance with the teachings of this invention.

DESCRIPTION OF THE INVENTION

Figure 1:
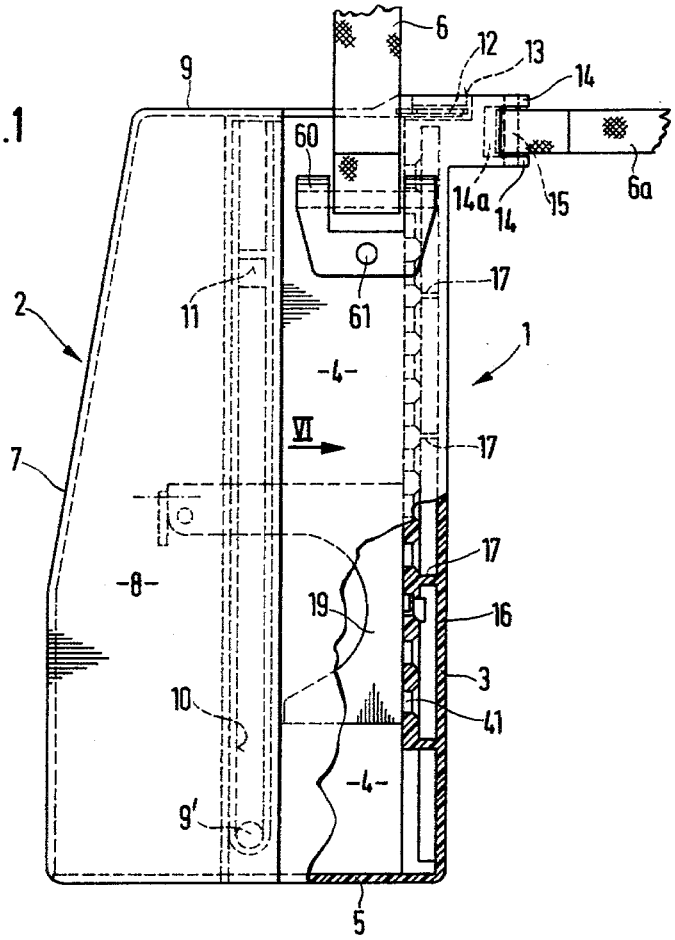
FIG. 1 is a side elevational view of one embodiment of a case embodying the invention of this application.

One embodiment of a shoulder case or bag made in accordance with this invention is illustrated in FIG. 1 and comprises a main storage container portion 1 and a lid portion 2. The main portion 1 has a rear wall 3 normally facing the bearer of the bag. In addition the bag includes two spaced vertical side walls 4 and a substantially horizontally disposed bottom 5. The lid 2 includes a front wall 7 normally facing away from the body of the bag carrier, in addition to two side wall portions 8 and an upper wall 9 all illustrated in FIG. 1. The front wall 7 of the lid 2 is sloped inwardly and upwardly as illustrated. The lid 2 is pivotally movable into an open position about pivot points 9' disposed in grooves 10 of container portion side walls 4. Locking projection 11 is disposed in each upper groove portion as illustrated. The lid is retained in position relative to container portion 1 by a slotted tongue 12 engaging a lock box 13 provided on upper edge of portion 1 in a manner known in the art. The container portion 1 contains an inner mounting wall 16 apertured as at 41 and spaced by means of spacers 17 from outer wall 3 whereon lens mounts such as mount 19 illustrated in phantom line in FIG. 1 may be mounted. Details of construction of such mounting wall 16 and lens mount 19 are presented in my commonly owned, co-pending application entitled A Photography Shoulder Bag With A Pivotal Lid filed of even date herewith, the disclosure of which is incorporated herein by reference.

The carrying strap 6 fragmentarily illustrated in FIG. 1 is suspended from the shoulder of the case bearer, the strap engaging the bag by means of pivotal strap connectors 16 which are freely pivoted about pins 61 extending perpendicularly from the opposed side walls 4 of the main bag portion 1 on which mounted. By virtue of such strap connection, the strap 6 will always adjust itself to the desired angular position relative to the bag irrespective of the shoulder on which the bag is carried by the bearer.

A waist strap **6*a* also fragmentarily illustrated in FIG. 1** is worn like a belt around the waist of the bag bearer and is attached to spaced pins disposed along an upper edge portion of the bag whereby the bag is securely bound to and rests on the body of the person carrying the same.

Figure 2:
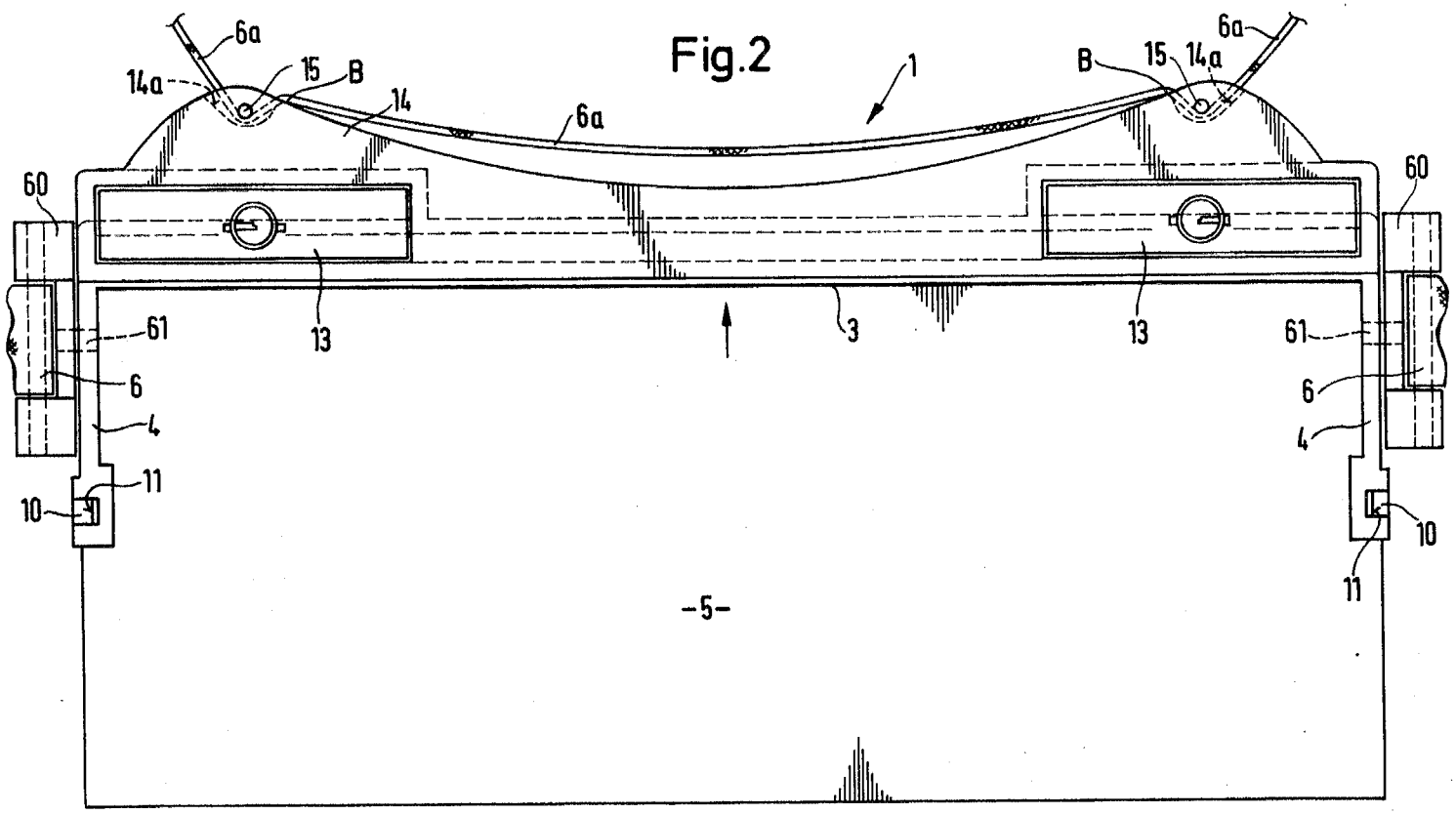
FIG. 2 is a bottom plan view of the case of FIG. 1.

It will be seen from FIG. 3 that upper edge portion 14 of the bag also illustrated in FIG. 1 is curved or bowed inwardly for purposes of generally fitting against the hip of the bag bearer. Pins 15 are arranged on terminal end portions of the rib edge 14. Each of the pins 15 is disposed in a recess **14*a*. The waist strap 6*a* after being drawn through the recesses and over the pins 15 is drawn tautly so as to lie on two contact points B see FIG. 2 against the hip of the wearer. The strap portion 6*a*** disposed between the contact points B will conform to the specific configuration of the body of the bag bearer thereby giving optimum support to the suspended bag.

The suspension of the bag on the body of the bearer is such that the lower region of the bag projects outwardly obliquely from the body of the bag bearer. Thus, the bag does not rub against the thigh of the bearer while walking. Such oblique disposition is made possible by virtue of the relative disposition between the pivot pins 61 for the strap connectors or links 60 so that the points of suspension of the suspension strap 6 on each side wall 4 is in vertical alignment with the center of gravity SP of the loaded bag in the manner illustrated in FIG. 4. As the link pins 61 are offset laterally outwardly relative to the center of gravity SP in the direction of the lid 1, and as the center of gravity always lies vertically in the plane of the suspension point, the entire bag including the rear wall is thus pivoted about the pins 61 into the desired oblique position spacing the rear surface 3 from the body of the case barrier. Thus the case engages the bearer by means of the rib 14 and straps 6 and 6A in the manner above indicated.

Accordingly, when the waist strap 6A is secured about the body of the bag bearer, the bag which rests against the bearer will then automatically pivot about the link pins 61 into the desired oblique position as the result of the arrangement of the pins 61 relative to the center of gravity of the bag in the manner illustrated in FIG. 4.

It is thus seen that a novel bag construction has been provided which by virtue of a simple suspension and attachment points enables the bearer to carry a bag with ease. Such bags of the prior art normally had dangled in a free manner so as to impede the movement of the person carrying the same.

It is believed that the above has made apparent a number of structural changes which may be effected which do not depart from the spirit of this invention. Accordingly, it is intended that this invention be limited only by the scope of the appended claims.

What is claimed is:

1. A shoulder bag comprising a carrying strap for supporting such bag on a shoulder of the bag bearer, said bag having a rear wall facing the body of the bearer in the normal course of use; said bag having opposed side walls; said rear wall of the shoulder bag having an edge portion defining a concavely arched rib for resting against the hip of he bag bearer; a waist strap for engaging spaced terminal end portions on the rib; connecting means engaging opposed end portions of said carrying strap; the carrying strap connecting means being pivotally mounted on upper portions of said bag side walls located below said waist strap; said connecting means being so located relative to the bag center of gravity whereby the bag rear wall is pivoted relative to said connecting means into an oblique position extending outwardly and downwardly relative to the bag arched rib when said bag is suspennded by said carrying strap in the vertical plane.

2. A shoulder bag comprising a carrying strap for supporting such bag on a shoulder of the bag bearer; said bag having a rear wall facing the body of the bearer in the normal positon of use; said bag having opposed side walls; said rear wall of the shoulder bag having an edge portion defining a concavely arched rib for supportably mounting on the hip of the bag bearer; a waist strap connected to spaced portions on the rib for securing said bag about the waist of a bag bearer; connecting means engaging opposed end portions of said carrying strap and pivotally mounted on upper portions of said bag side walls; means disposed on said bag side walls for pivotally mounting said connecting means and located below said waist strap; said bag having a center of gravity which is so located relative to the mounting means whereby the bag pivots relative to said connecting means into an oblique position extending outwardly and downwardly relative to the bag arched rib when said bag is suspended in the vertical plane by said carrying strap.

3. A shoulder bag according to claims 1 or 2 wherein terminal end portions of said rib have recesses formed therein and a strap-engaging pin is mounted in each recess.

4. A shoulder bag according to claim 3 wherein said waist strap is continuous and is drawn through said recesses behind said pins mounted therein.

5. A shoulder bag according to claims 1 or 2 wherein the upper, outer surface of the bag slopes upwardly and inwardly in the normal suspended position of use.

6. A shoulder bag according to claim 1 or 2 wherein each of said connecting means comprises a hinge engaging an end of the carrying strap and is pivotally mounted on a pin extending perpendicularly from side wall upper portions of said bag located below the waist strap.

* * * * *